US005722650A

United States Patent [19]

Yamamoto et al.

[11] Patent Number: 5,722,650

[45] Date of Patent: Mar. 3, 1998

[54] SORTER APPARATUS CAPABLE OF SHIFTING SHEET ON TRAY TOWARD PREDETERMINED SIDE SURFACE

[75] Inventors: Masahito Yamamoto; Yasuyuki Aiko, both of Yokohama; Satoshi Kuroyanagi, Inagi; Mitsuhiko Sato; Yoshihito Osari, both of Kawasaki, all of Japan

[73] Assignee: Canon Kabushiki Kaisha, Tokyo, Japan

[21] Appl. No.: 497,463

[22] Filed: Jun. 30, 1995

[30] Foreign Application Priority Data

Jul. 7, 1994 [JP] Japan ..... 6-155805

[51] Int. Cl.[6] ..... B65H 39/02

[52] U.S. Cl. ..... 270/58.02; 270/58.09; 270/58.16; 270/58.17; 270/58.27; 271/221

[58] Field of Search ..... 270/58.02, 58.08, 270/58.09, 58.14, 58.16, 58.17, 58.18, 58.19, 58.27, 58.31; 271/176, 220, 221; 355/324

[56] References Cited

U.S. PATENT DOCUMENTS 3,774,906 11/1973 Fagan et al. ..... 270/58.16 X
3,910,568 10/1975 Brown et al. ..... 271/221
5,382,016 1/1995 Kobayashi et al. ..... 270/58.16 X
5,384,634 1/1995 Takehara et al. ..... 270/58.18 X

FOREIGN PATENT DOCUMENTS 57-156957 9/1982 Japan ..... 270/58.01
3-279163 12/1991 Japan ..... 271/176

OTHER PUBLICATIONS

U.S. application Serial No. 08/662,181, filing date: Jun. 12, 1996.
U.S. application Serial No. 08/497,466, filing date: Jun. 30, 1996.

*Primary Examiner*—Hoang Nguyen
*Attorney, Agent, or Firm*—Fitzpatrick, Cella, Harper & Scinto

[57] ABSTRACT

This invention has as its object to provide a sorter apparatus which allows to easily identify bundles of sheets in units of jobs. After the end of each job operation, if a bundle of sheets of the preceding job remain on the sorter, a message for removing sheets is displayed, and the control waits until the sheets are removed. When no bundle of sheets of the preceding job remain or when the bundle of sheets of the preceding job are removed, a bundle of sheets of the current job are pushed and shifted, and execution of the next job is permitted. With this control, a step can be formed between bundles of sheets in units of jobs, and the bundles of sheets in units of jobs can be easily sorted.

23 Claims, 9 Drawing Sheets

SORTER APPARATUS CAPABLE OF SHIFTING SHEET ON TRAY TOWARD PREDETERMINED SIDE SURFACE

BACKGROUND OF THE INVENTION

1. Field of the Invention

The present invention relates to a sorter apparatus which can shift sheets on a tray toward a predetermined side surface.

2. Related Background Art

Some image forming apparatuses such as copying machines, printers, and facsimile apparatuses comprise a sorter apparatus for sorting and grouping sheets discharged from an image forming apparatus main body.

In the sorter apparatus used in such an image forming apparatus, an examination has been made to push a bundle of sorted or grouped sheets toward a predetermined side of the apparatus by a mechanism for aligning, pushing, and shifting the bundle of sheets. Using this predetermined side pickup function, bundles of sheets obtained by different jobs can be stacked. In addition, since a predetermined shift is formed between a bundle of sheets pushed by the predetermined side pickup function and another bundle of sheets stacked thereon, a user who is about to pick up a bundle of sheets obtained by a given job can easily identify the boundary between different jobs.

However, the number of jobs which allows easy identification of bundles of sheets corresponding to different jobs by the push & shift mechanism has a predetermined upper limit in terms of the mechanism. For example, in a mechanism which has only two positions, in a tray, where bundles of sheets can be stably stacked, the boundary between only two bundles of sheets, i.e., a bundle of sheets which is pushed and shifted by one step, and a bundle of sheets which is neither pushed nor shifted, can be identified. In such a mechanism, when bundles of sheets obtained by a series of image forming jobs, which are successively or intermittently scheduled, are simply stacked and pushed/shifted, the bundles of sheets cannot be shifted in units of jobs, and it becomes difficult to obtain bundles of sheets in units of jobs.

SUMMARY OF THE INVENTION

It is an object of the present invention to provide a sorter apparatus which can solve the above-mentioned problem.

It is another object of the present invention to provide a sorter apparatus which can prevent a plurality of groups of bundles of sheets from being mixed.

It is still another object of the present invention to provide a sorter apparatus which controls to inhibit or permit the push & shift operation of sheets on a tray.

Other objects and features of the present invention will become apparent from the following description taken in conjunction with the accompanying drawings.

DETAILED DESCRIPTION OF THE PREFERRED EMBODIMENTS

(First Embodiment)

Figure 1:
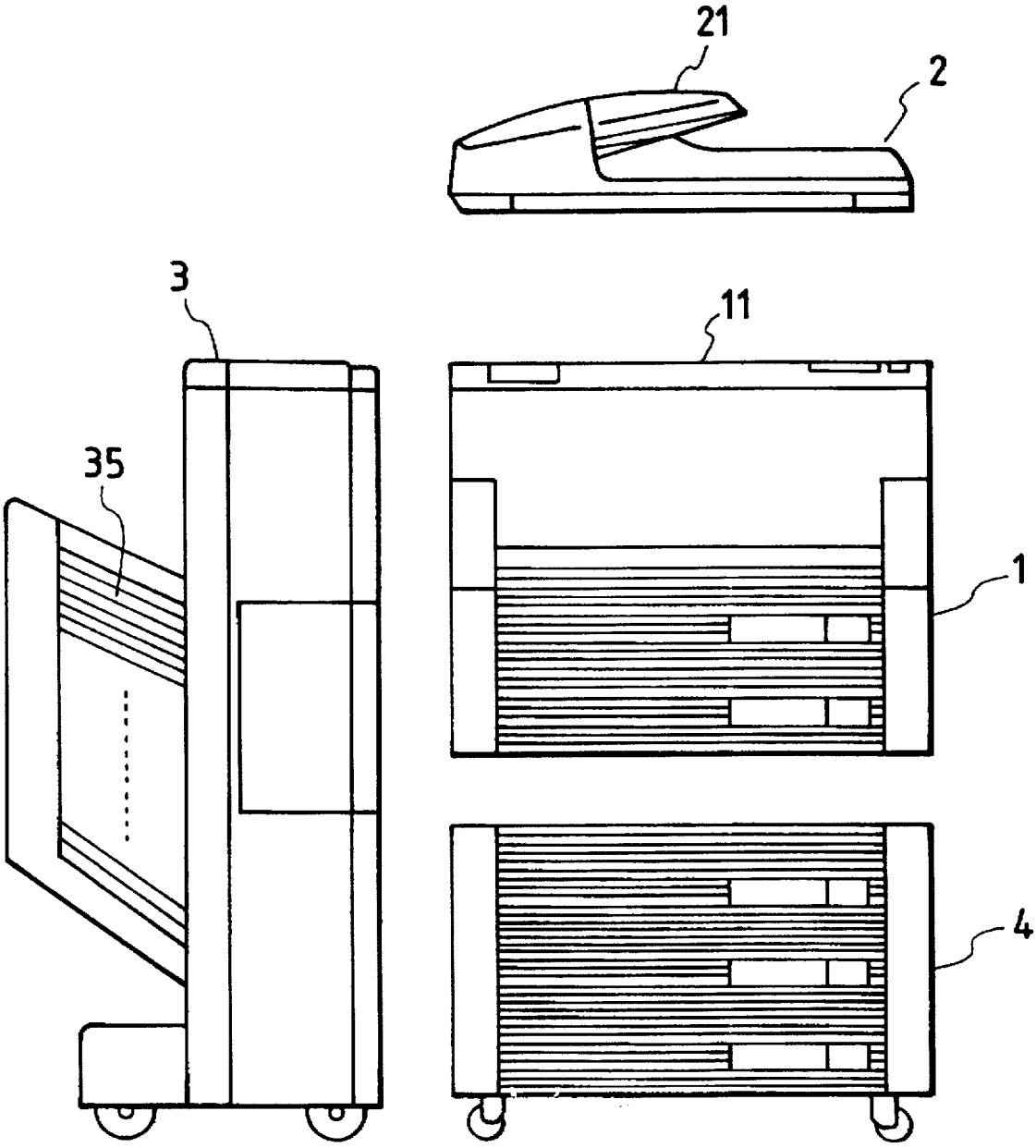
FIG. 1 is a front view showing respective units according to the first embodiment of the present invention.

FIG. 1 is a front view of respective units of an "image forming apparatus" according to the first embodiment of the present invention. Referring to FIG. 1, an image forming apparatus main body 1 forms an image on a sheet by a known electrophotography method on the basis of image information obtained by scanning an original image placed on a platen glass 11 on the upper surface of the main body 1 or image information input from an external image information output apparatus (not shown) via known image data transmission communication means, and thermally fixes the formed image. An automatic original feeder (DH) 2 is connected to the image forming apparatus main body 1. Furthermore, a sorter 3 is also connected to the image forming apparatus main body 1. The sorter 3 has a plurality of sheet storage trays 35 which are used for sorting or grouping sheets which are already formed with images and are output from the image forming apparatus main body 1. Sheets which are sorted or grouped on each sheet storage tray 35 are pushed and shifted toward the front side of the apparatus by an alignment bar 33 (see FIG. 2), so that a user can easily pick up sheets from the front surface side of the apparatus. By the push & shift operation, bundles of sheets obtained by different jobs can be stacked in a single storage tray while being shifted from each other. Also, an auxiliary paper feed cassette module 4 is connected to the image forming apparatus main body 1, and one cassette in the auxiliary paper feed cassette module 4 is used for storing partition paper sheets.

The operation of the sorter 3 will be described below with reference to FIGS. 2 to 7. FIGS. 2 to 7 are top views showing the operations of the sheet storage trays of the sorter 3 when viewed from above the apparatus.

Figure 2:
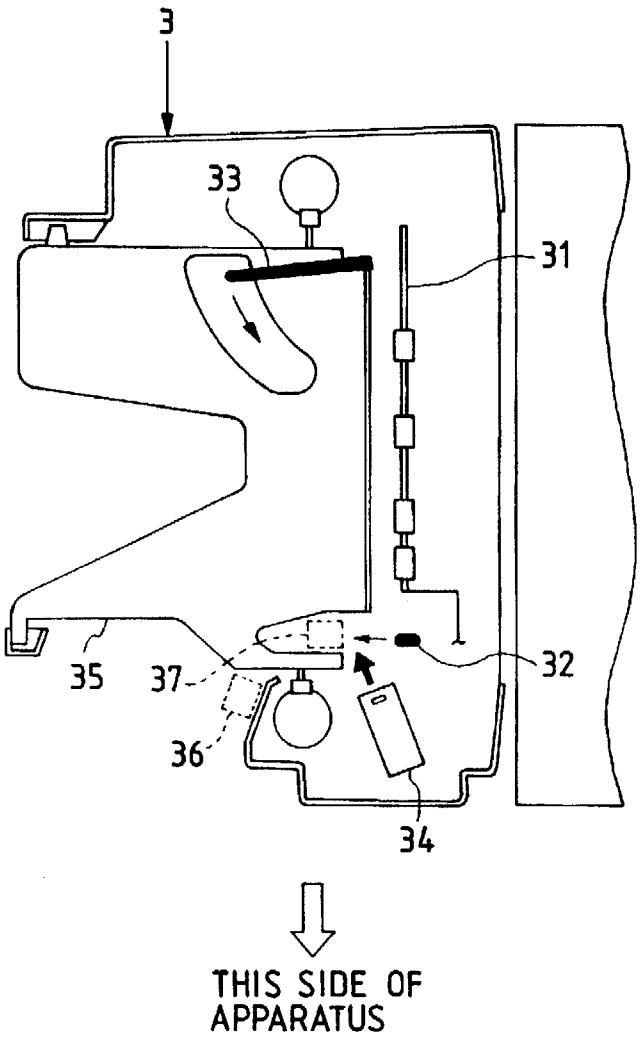
FIG. 2 is a view showing the arrangement of a sorter.

The respective units of the sorter 3 will be explained below with reference to FIG. 2. A discharge roller 31 is used for discharging a sheet fed from the image forming apparatus main body 1 onto each sheet storage tray 35. A reference bar 32 is movable in the right-and-left direction in the plane of the drawing of FIG. 2, and aligns sheets on each sheet storage tray in cooperation with the alignment bar 33. The reference bar 32 and the alignment bar 33 extend in the vertical direction. A stapler 34 moves forward in the direction of an arrow in FIG. 2 and staples sheets. After the end of stapling, the stapler 34 returns to the illustrated position in FIG. 2. About 50 sheets can be stacked on each sheet storage tray 35. A front-side pickup sensor 36 detects if sheets are pushed and shifted to the front side of the apparatus. The sensor 36 comprises a light-emitting diode and a photosensor. The light-emitting diode is arranged in the lower portion of the sorter 3, and the photosensor is arranged in the upper portion of the sorter 3. A sheet sensor 37 has an arrangement similar to that of the front-side pickup sensor 36, and detects the presence/absence of sheets stacked in each storage tray 35.

Figure 3:
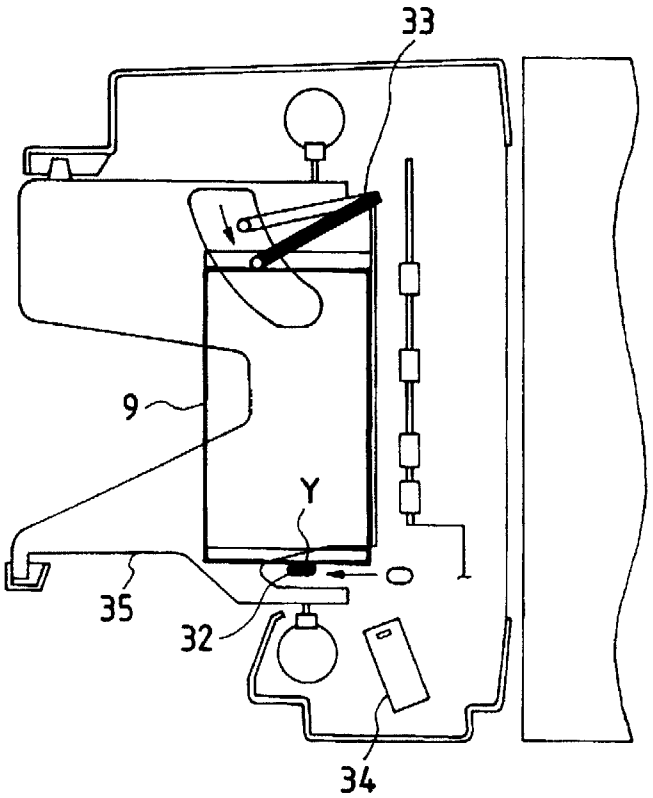
FIG. 3 is a view showing a state wherein sheets are stored in a storage tray.
Figure 5:
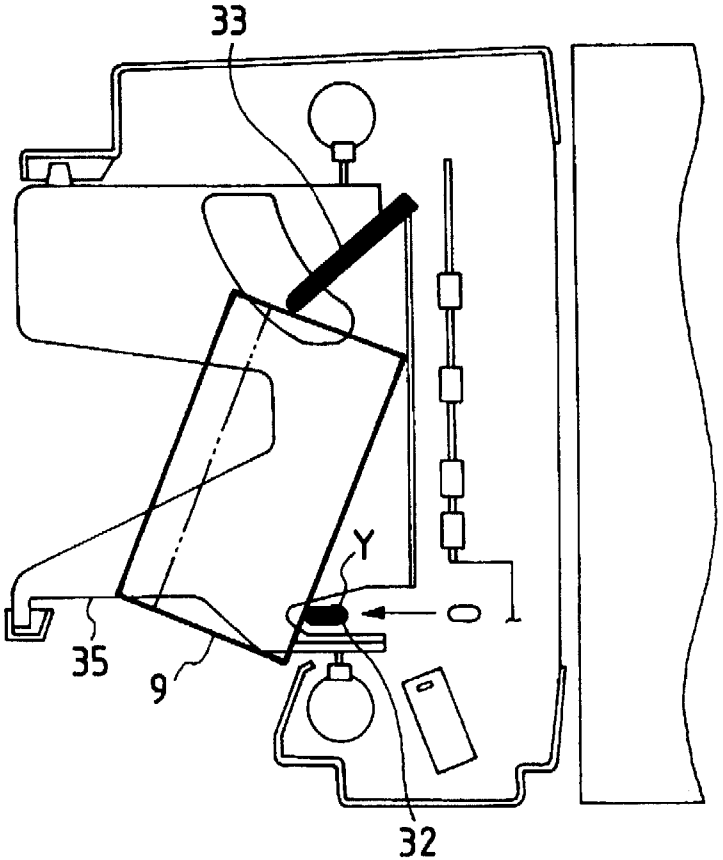
FIG. 5 is a view showing the operation for inclining the bundle of discharged sheets using a reference bar.
Figure 4:
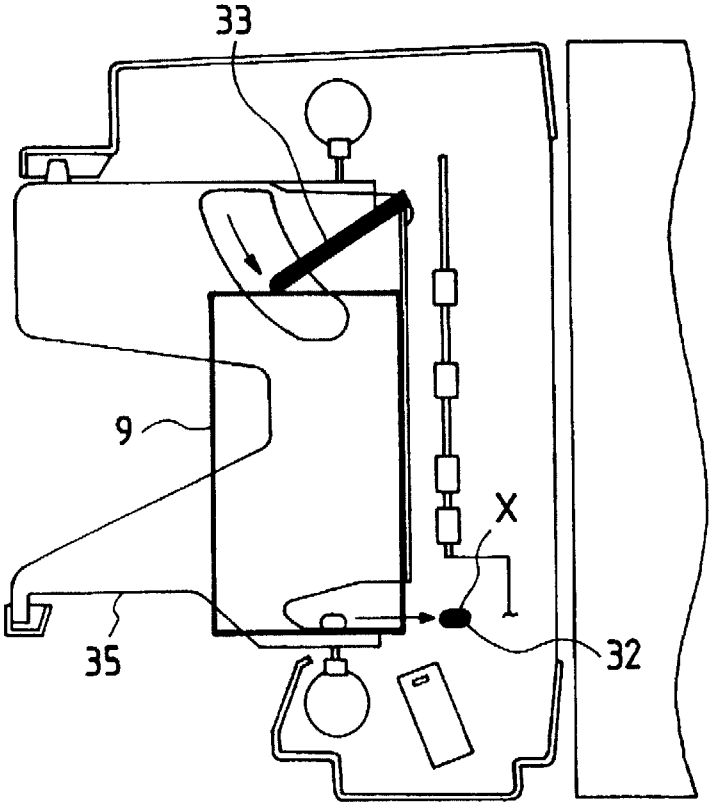
FIG. 4 is a view showing the operation for pushing a bundle of discharged sheets outside the storage tray by an alignment bar.
Figure 7:
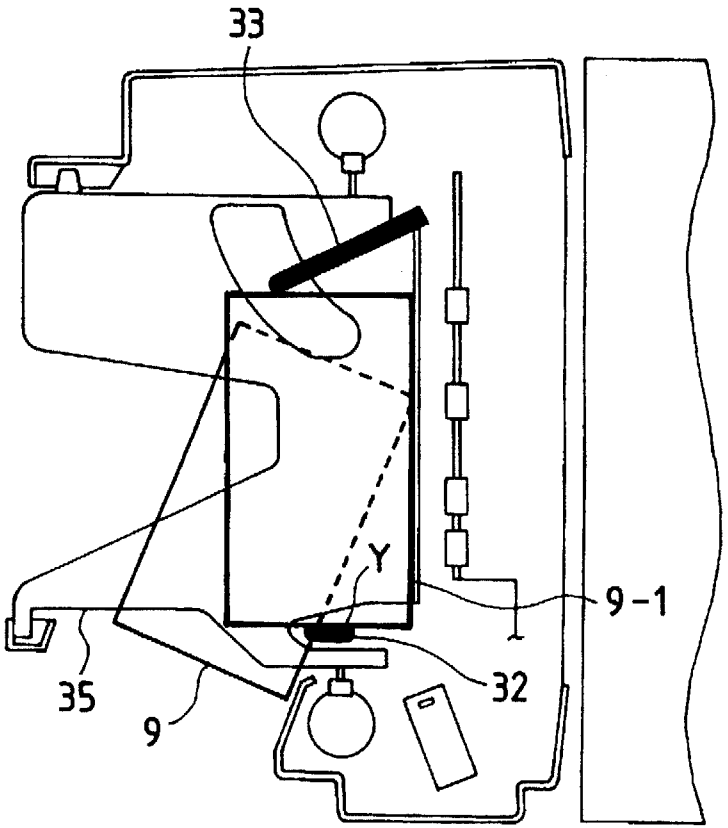
FIG. 7 is a view showing the alignment operation of a bundle 9-1 of discharged sheets.
Figure 6:
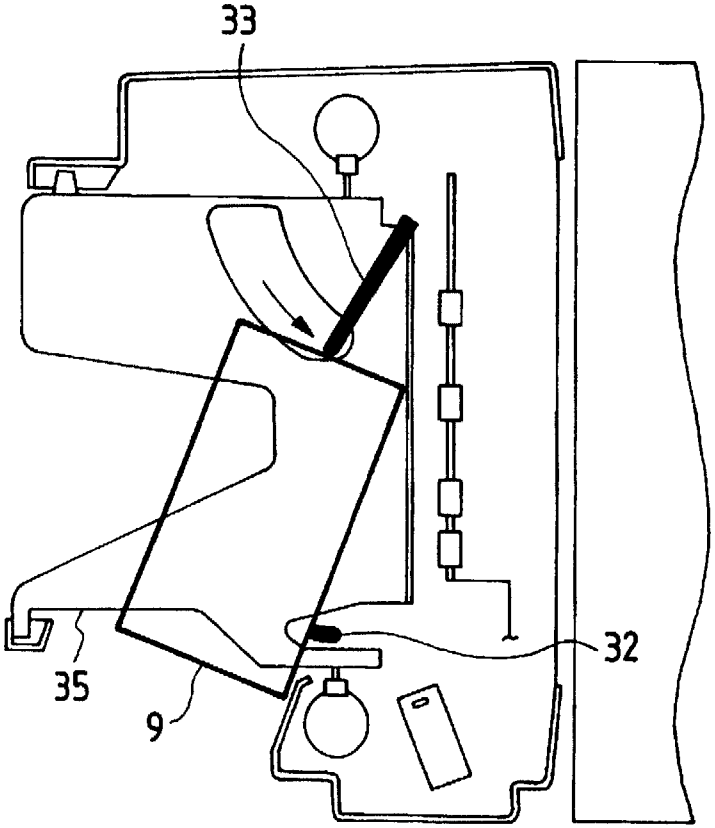
FIG. 6 is a view showing the operation for pushing the bundle of discharged sheets in the exit direction using the alignment bar.

A state wherein the reference bar 32 and the alignment bar 33 push sheets 9 while shifting them toward the front side will be explained in turn below with reference to FIGS. 3 to 7. FIG. 3 shows a state wherein a sheet 9 is stored in each storage tray 35. The reference bar 32 stands by at a position Y in FIG. 3. When the sheet 9 is stored in the storage tray 35, the alignment bar 33 moves in the direction of an arrow in FIG. 3, and pushes the sheet 9 until the sheet contacts the reference bar 32. The alignment bar 33 repeats the same operation each time one sheet is discharged, until all the sheets are stored in the storage tray 35. FIG. 4 shows the operation performed after all the sheets 9 in one group are stored in the storage tray 35. The reference bar 32 moves backward to a standby position X in FIG. 4, and the alignment bar 33 further pushes the sheets 9 forward. Then, as shown in FIG. 5, the reference bar 32 moves forward to the position Y, and the sheets 9 are inclined to be directed in the exit direction at the front side. Furthermore, as shown in FIG. 6, the alignment bar 33 further pushes the sheets 9 in the exit direction. In the state shown in FIG. 6, a user can pick up the sheets from the front side of the apparatus. Even if these sheets 9 are not removed, the alignment operation of a sheet 9-1 fed by the next image forming operation can be performed since the reference bar 32 moves forward to and stops at the position Y again, as shown in FIG. 7. Note that a stapling operation is performed using the stapler 34 in the state shown in FIG. 3.

Figure 8:
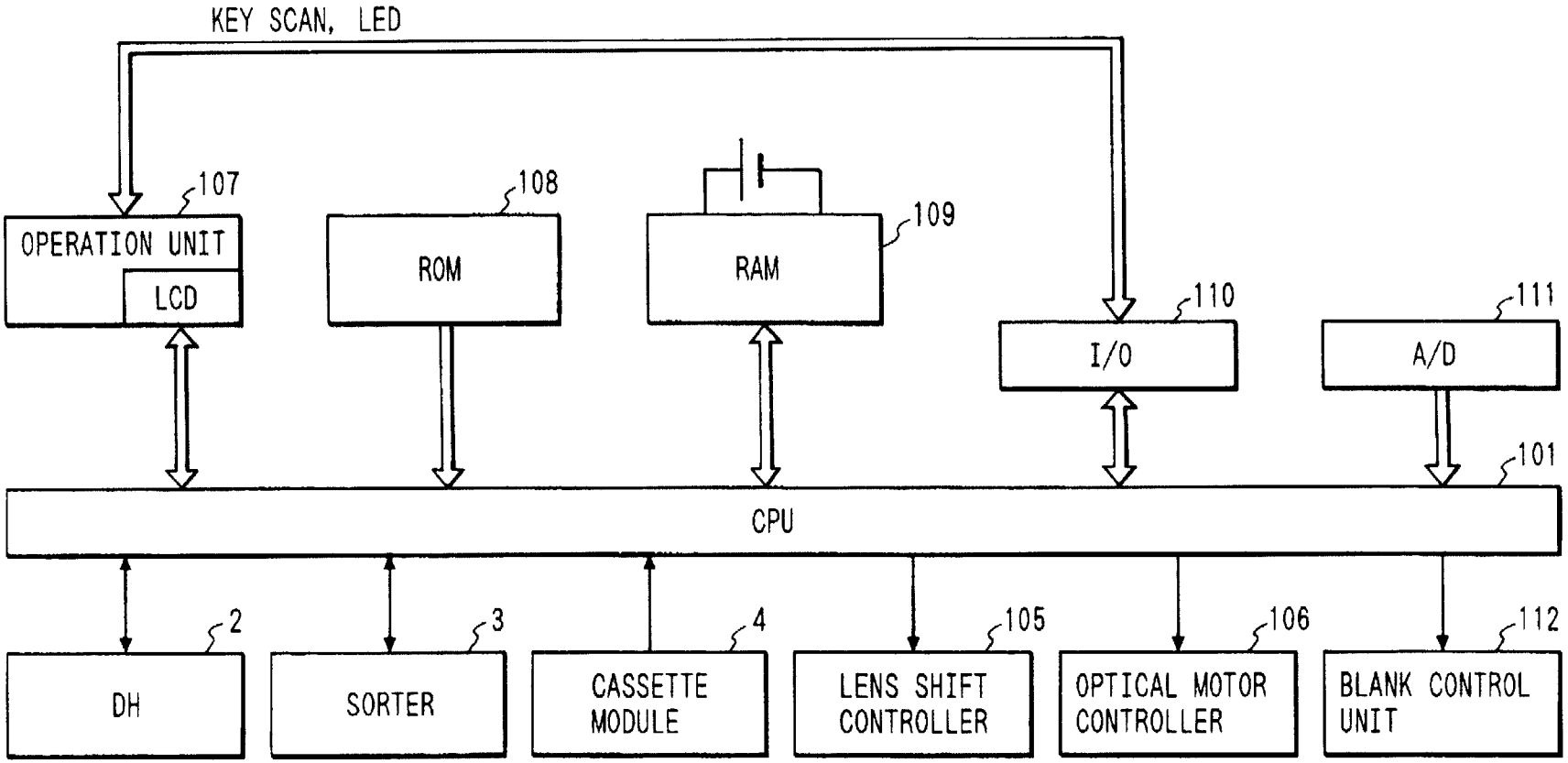
FIG. 8 is a block diagram showing the hardware arrangement of the first embodiment.

The hardware arrangement of a microcomputer required for realizing the operation of this embodiment will be described below with reference to FIG. 8. Referring to FIG. 8, a CPU 101 controls the image forming apparatus main body 1. A ROM 108 stores control contents (programs). A RAM 109 stores data necessary for control, and is backed up by a battery so as not to lose its storage contents even after the power switch is turned off.

An operation unit 107 is used for designating an image forming mode including the number of copies, magnification, paper feed cassette, and the like, and displays the designated image forming mode using an LCD (liquid crystal display). An external operation unit (not shown in FIG. 8) may be arranged outside the image forming apparatus main body 1, and may be connected to the image forming apparatus main body 1 via known communication means so as to remote-control the main body 1. An I/O 110 controls input and output ports required for control. An A/D converter 111 converts analog data supplied from, e.g., a temperature sensor of a fixing device, a room temperature sensor, and the like required for control into digital data. In addition, this circuit is connected to the automatic original feeder 2, the sorter 3, and the auxiliary paper feed cassette module 4 including the partition paper cassette, which are connected to the image forming apparatus main body 1.

Figure 9:
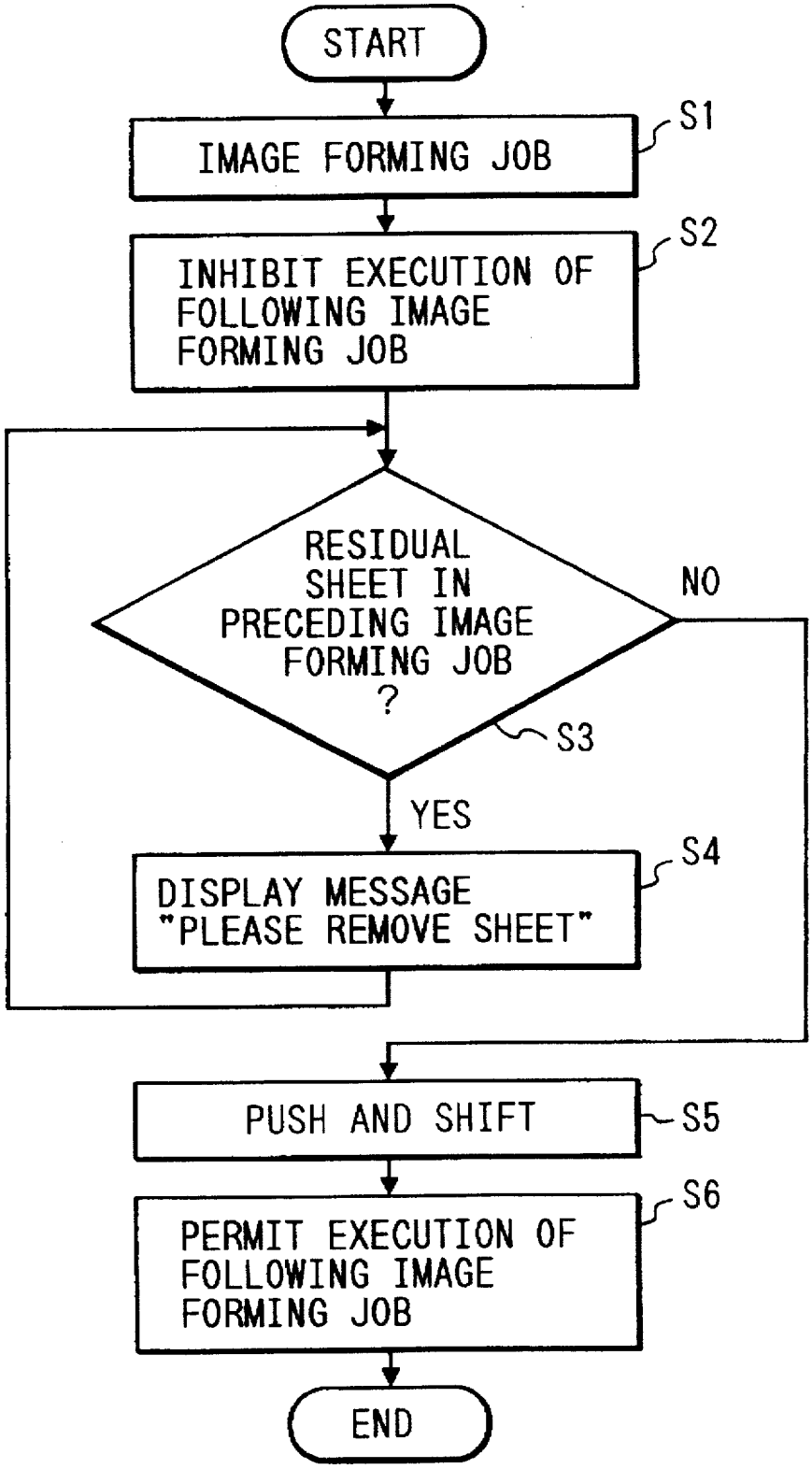
FIG. 9 is a flow chart showing the operation of the first embodiment.

The operation of this embodiment will be described below with reference to the flow chart shown in FIG. 9. An image forming job N, which is instructed to start by the operation unit 107 or a remote operation unit (not shown), is executed in step 1 (to be described as "S1" hereinafter). Upon completion of the image forming job N in step S1, execution of the next image forming job N+1 is temporarily inhibited in step S2, and the front-side pickup sensor 36 (see FIG. 2) detects if sheets obtained in the preceding image forming job N−1 remain on the sheet storage tray 35 in a shifted state (S3). If YES in step S3, a message requiring a user to remove the sheets on the sorter 3 is displayed on the operation unit 107 or the remote operation unit (S4), and the flow returns to decision step S3. On the other hand, if NO in step S3, the sheets obtained by the current job N are pushed and shifted (S5). Thereafter, execution of the next image forming job N+1 is permitted (S6), thus ending control associated with the current job N.

In this manner, the boundaries of jobs formed by the push & shift operation can be maintained, and bundles of discharged sheets in units of jobs can be easily sorted.

(Second Embodiment)

Figure 10:
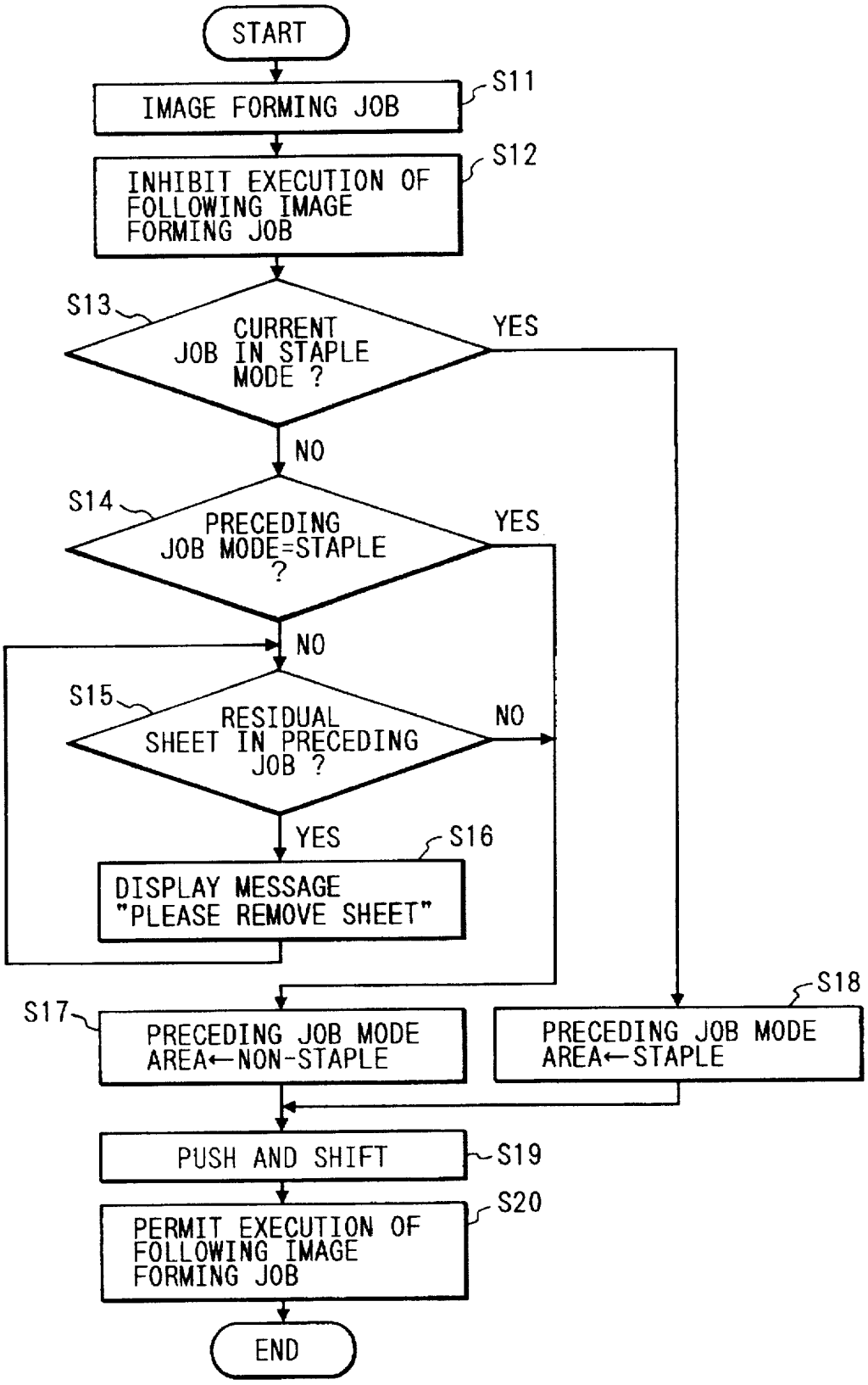
FIG. 10 is a flow chart showing the operation according to the second embodiment of the present invention.

The operation of this embodiment will be described below with reference to the flow chart shown in FIG. 10. The hardware arrangement of this embodiment is the same as that in the first embodiment, and a detailed description thereof will be omitted.

An image forming job N, which is instructed to start by the operation unit 107 or a remote operation unit (not shown), is executed in step S11. Upon completion of the image forming job N in step S11, execution of the next image forming job N+1 is temporarily inhibited in step S12, and it is checked if the current job N is executed in the staple mode (S13). If YES in step S13, a bundle of sheets have been bound by the stapler 34 in the final process of the image forming job in step S11, and hence, the bundle of sheets obtained in the current job can be stacked at the position in FIG. 6 on the bundle of sheets obtained by the preceding job N−1 and shifted in the state shown in FIG. 6. In this case, the flow jumps to step S18. On the other hand, if it is determined in step S13 that the current job N is executed in a non-staple mode, it is checked if the bind mode of the preceding job N−1 stored in a preceding job mode storage area in the RAM 109 is the staple mode (S14). If YES in step S14 (including a case wherein no value is stored in the preceding job mode storage area), the flow jumps to step S17. However, if NO in step S14, the flow advances to step S15, and the front-side pickup sensor 36 detects if sheets obtained by the preceding job N−1 remain in a shifted state. If YES in step S15, a message requiring a user to remove the sheets on the sorter 3 is displayed on the operation unit 107 or the remote operation unit (S16), and the flow returns to decision step S15. On the other hand, if NO in step S15, the flow advances to step S17. In step S17, the non-staple mode as the operation mode of the current job N is stored in the preceding job mode storage area, and the flow advances to step S19. On the other hand, in step S18, the staple mode as the operation mode of the current job N is stored in the preceding job mode storage area, and the flow advances to step S19. In step S19, a bundle of discharged sheets of the current job N are pushed and shifted. In step S20, execution of the next image forming job N+1 is permitted, thus ending control associated with the current job N.

As described above, when the operation mode of the current or preceding job N or N−1 is the staple mode, since the bundles of sheets of these jobs can be identified by staples even after the push & shift operation, the push & shift operation is performed, and the next job is executed. If no residual sheets of the preceding job are detected, the push & shift operation may be directly performed.

(Third Embodiment)

Figure 11:
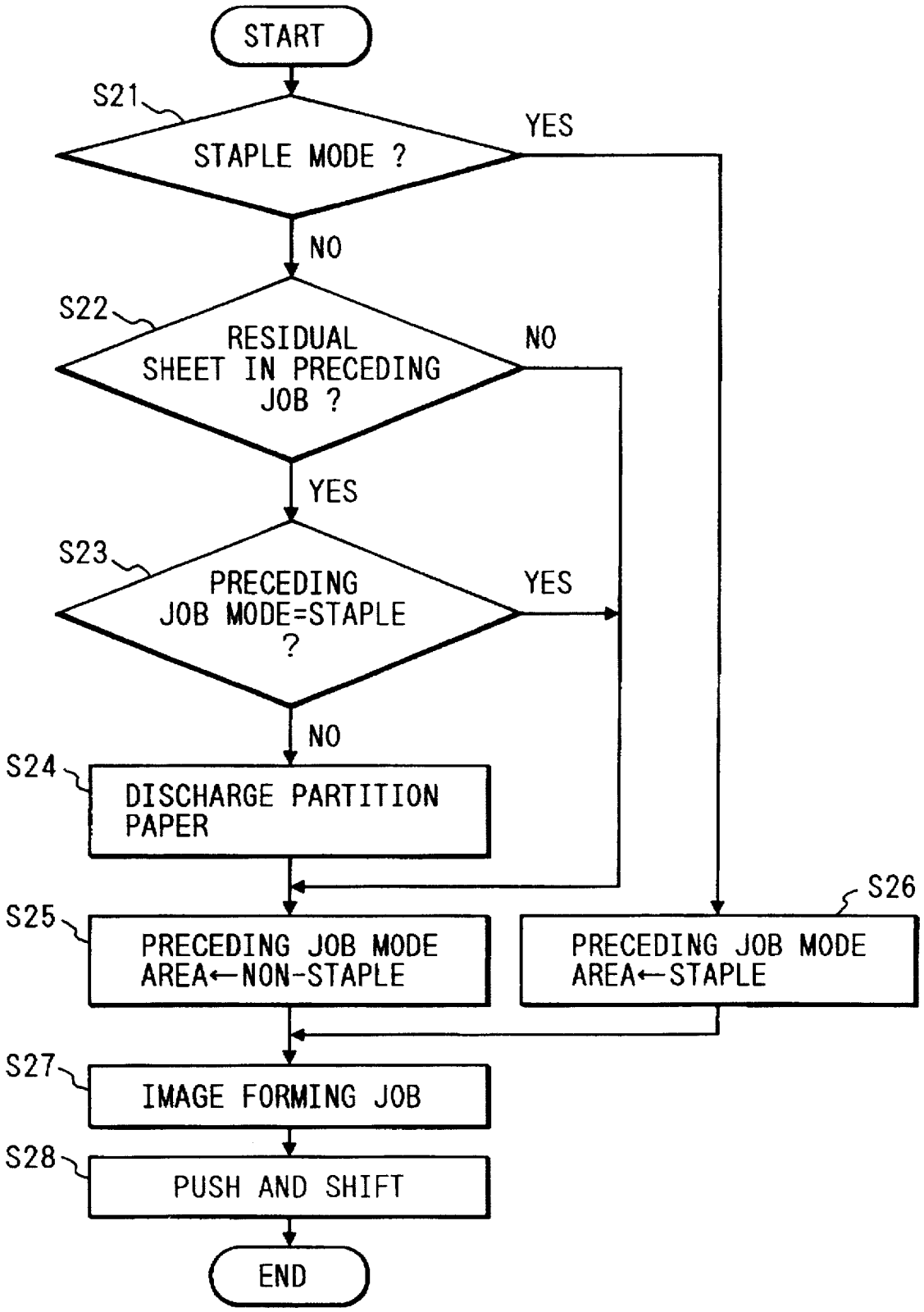
FIG. 11 is a flow chart showing the operation according to the third embodiment of the present invention.

The operation of this embodiment will be described below with reference to the flow chart shown in FIG. 11. The hardware arrangement of this embodiment is the same as that in the first embodiment, and a detailed description thereof will be omitted.

Figure 7A:
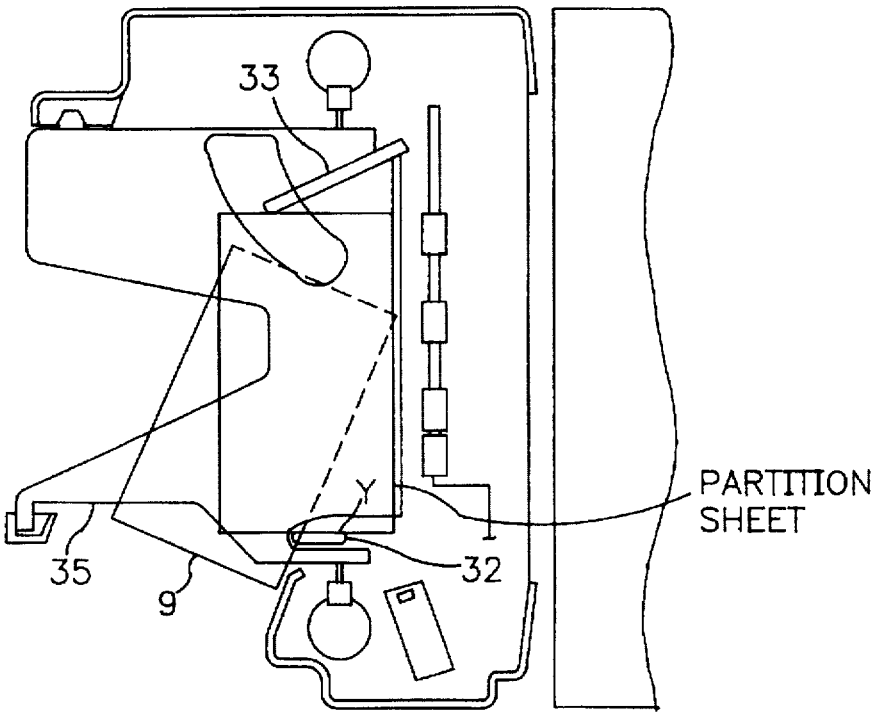
FIGS. 7A and 7B are views showing a partition sheet.
Figure 7B:
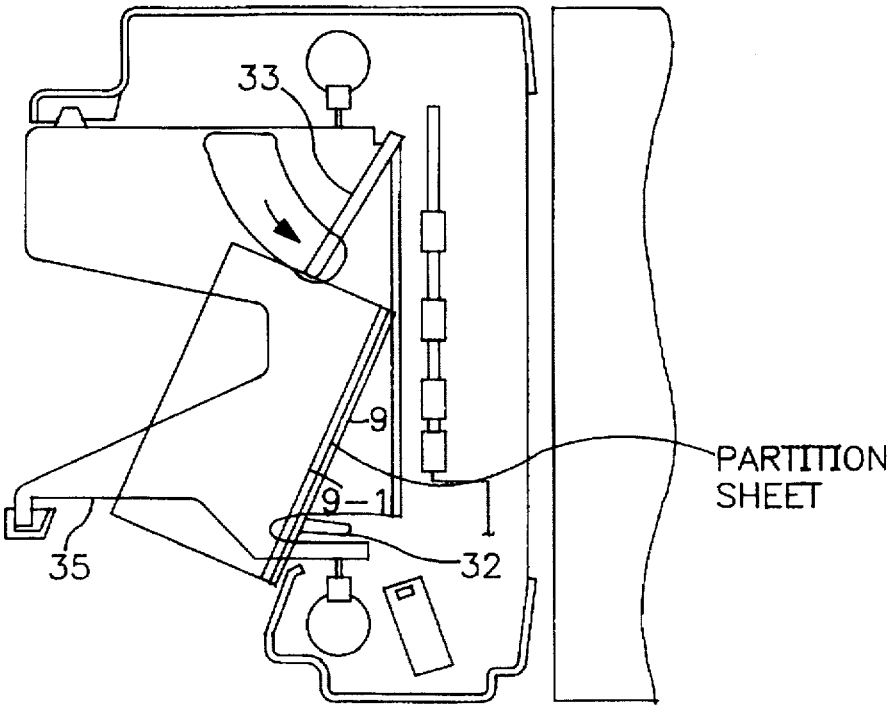

When an image forming job N is instructed to start by the operation unit 107 or a remote operation unit (not shown), it is checked if the job N is started in the staple mode (S21). If YES in step S21, a bundle of sheets will be bound by the stapler 34 in the final process of the image forming job in step S27 (to be described later), and hence, the bundle of sheets obtained in the current job can be stacked at the position in FIG. 6 on the bundle of sheets obtained by the preceding job N−1 and shifted to the position shown in FIG. 6. In this case, the flow jumps to step S26. On the other hand, if it is determined in step S21 that the current job N is executed in a non-staple mode, the flow advances to step S22, and the front-side pickup sensor 36 detects if sheets obtained by the preceding job N−1 remain in a shifted state. If NO in step S22, the flow jumps to step S25 (to be described later). However, if YES in step S22, the flow advances to step S23 to check if the operation mode of the preceding job N−1 stored in the preceding job mode storage area the RAM 109 is the staple mode. If YES in step S23 (including a case wherein no value is stored in the preceding job mode storage area), the flow jumps to step S25. However, if NO in step S23, since the step from the bundle of discharged sheets in the preceding job may become difficult to identify if a bundle of sheets of the current job N are discharged and are pushed and shifted in this state, a partition paper sheet (e.g. FIGS. 7A and 7B) is fed from the auxiliary paper feed cassette module 4 including the partition paper cassette, and is discharged (S24). Thereafter, the flow advances to step S25. In step S25, the non-staple mode as the bind mode of the current image forming job N to be executed is stored in the preceding job storage area. On the other hand, in step S26, the staple mode as the bind mode of the current image forming job N to be executed is stored in the preceding job storage area. The flow then advances to step S27 to execute the image forming job. In step S28, the push & shift operation of the bundle of sheets is performed, thus ending control associated with the current job.

As described above, when the bind mode of the current or preceding job N or N−1 is not the staple mode, and sheets of the preceding job remain, the bundles of sheets discharged by the two jobs may become difficult to identify if the current job is executed in this state and the push & shift operation is performed. For this reason, after a partition paper sheet is discharged, the current job is executed, and the push & shift operation is performed. As a result, the bundles of sheets discharged by the two jobs can be easily sorted by the partition paper sheet.

(Modification)

In each of the above embodiments, a bundle of sheets are pushed and shifted in an oblique direction. However, the present invention is not limited to this. For example, a bundle of sheets may be shifted in a direction parallel to the side portion of the bundle of sheets. More specifically, the bundle of sheets need only be shifted to form a step between bundles of sheets.

The present invention may be applied to a case wherein synthetic paper, films, and the like other than "paper" are used in place of sheets and partition paper sheets.

As described above, according to the present invention, it is automatically discriminated if the next job can be executed while maintaining the identification means of steps between bundles of discharged sheets in units of jobs even after a bundle of sheets discharged in the current job are pushed and shifted. If it is determined that the next job can be executed, the bundle of discharged sheets are pushed and shifted, and the next job is executed; otherwise, execution of the next job is inhibited or a partition paper sheet is discharged. In this manner, a user can easily identify bundles of sheets in units of jobs, the number of jobs which can successively discharge sheets can be increased as much as possible, and a partition paper sheet is discharged if necessary. Thus, the efficiency and convenience of an output apparatus of a series of image forming jobs can be improved.

What is claimed is:

1. A sheet stacking apparatus comprising:

a tray for stacking a sheet;

sheet shift means for shifting the sheet on said tray;

detection means for detecting if the sheet shifted by said sheet shift means is present on said tray; and control means responsive to said detection means for controlling said sheet shift means so as not to be operated when the shifted sheet is present on said tray.

2. An apparatus according to claim 1, wherein said sheet shift means comprises a rod-like member extending in a vertical direction.

3. An apparatus according to claim 2, wherein said sheet shift means comprises first and second rod-like members, wherein said first rod-like member pushes and shifts the sheet on said tray toward the predetermined side surface, and wherein said second rod-like member shifts the sheet so that one of the corners of the sheet is directed toward the predetermined-side surface.

4. An apparatus according to claim 1, wherein said apparatus is connected to an image forming apparatus, and said sheet shift means operates after said image forming apparatus discharges a group of sheets onto said apparatus.

5. An apparatus according to claim 1, wherein said apparatus comprises a plurality of said trays.

6. An apparatus according to claim 1, wherein said sheet shift means shifts the sheet so as to stick out from said tray.

7. An apparatus according to claim 6, wherein said sheet shift means shifts a corner of the sheet so as to stick out from said tray.

8. A sheet stacking apparatus comprising:

a tray for stacking a sheet;

binding processing means for performing binding processing of sheets on said tray;

sheet shift means for shifting the sheet on said tray;

discriminating mans for discriminating that the binding processing is not performed for sheets of a preceding job and the binding processing is not performed for sheets of a current job; and control means for, controlling said sheet shift means not to shift the sheets of the current job in accordance with a discrimination result by said discriminating means.

9. An apparatus according to claim 7, wherein said sheet shift means comprises a rod-like member extending in a vertical direction.

10. An apparatus according to claim 9, wherein said sheet shift means comprises first and second rod-like members, wherein said first rod-like member pushes and shifts the sheet on said tray toward the predetermined-side surface, and wherein said second rod-like member shifts the sheet so that one of the corners of the sheet is directed toward the predetermined-side surface.

11. An apparatus according to claim 8, wherein said apparatus is connected to an image forming apparatus, and said sheet shift means operates after said image forming apparatus discharges a group of sheets onto said apparatus.

12. An apparatus according to claim 8, wherein said apparatus comprises a plurality of said trays.

13. An apparatus according to claim 8, wherein said sheet shift means shifts the sheet so as to stick out from said tray.

14. An apparatus according to claim 13, wherein said sheet shift means shifts a corner of the sheet so as to stick out from said tray.

15. A sheet stacking apparatus comprising:

a tray for stacking a sheet;

binding processing means for performing binding processing of sheets on said tray;

sheet shift means for shifting the sheet on said tray;

discriminating means for discriminating that at least one of the binding processing for sheets of a preceding job and the binding processing for sheets of a current job is performed; and control means for permitting the operation for shifting the sheets of the current job by said sheet shift means in accordance with a discrimination result by said discriminating means.

16. An apparatus according to claim 15, wherein said sheet shift means comprises a rod-like member extending in a vertical direction.

17. An apparatus according to claim 16, wherein said sheet shift means comprises first and second rod-like members, wherein said first rod-like member pushes and shifts the sheet on said tray toward the predetermined-side surface, and wherein said second rod-like member shifts the sheet so that one of the corners of the sheet is directed toward the predetermined-side surface.

18. An apparatus according to claim 15, wherein said sheet stacking apparatus is connected to an image forming apparatus, and said sheet shift means operates after said image forming apparatus discharges a group of sheets onto said sheet stacking apparatus.

19. An apparatus according to claim 15, wherein said apparatus comprises a plurality of said trays.

20. An apparatus according to claim 15, wherein said sheet shift means shifts the sheet so as to stick out from said tray.

21. An apparatus according to claim 20, wherein said sheet shift means shifts a corner of the sheet so as to stick out from said tray.

22. A sheet processing apparatus comprising:

a tray for stacking a sheet;

binding processing means for performing binding processing of sheets on said tray;

discriminating means for discriminating that the binding processing is not performed for sheets of a preceding job and the binding processing is not performed for sheets of a current job; and control means for controlling to stack a partition paper sheet on said tray before sheets of the current job are stacked on said tray in accordance with a discrimination result by said discriminating means.

23. An apparatus according to claim 22, wherein said apparatus comprises a plurality of said trays.

* * * * *

UNITED STATES PATENT AND TRADEMARK OFFICE

CERTIFICATE OF CORRECTION

PATENT NO. : 5,722,650

DATED : March 3, 1998

INVENTOR(S) : YAMAMOTO et al.

It is certified that error appears in the above-identified patent and that said Letters Patent is hereby corrected as shown below:

Column 6

Line 46, "mans" should read --means--.

Signed and Sealed this

First Day of September, 1998

*Attest:*

*Attesting Officer*

BRUCE LEHMAN

*Commissioner of Patents and Trademarks*